US012553167B2

(12) United States Patent
Ryu et al.

(10) Patent No.: US 12,553,167 B2
(45) Date of Patent: Feb. 17, 2026

(54) DETECTING A WASH SUBSTANCE DURING A WASH CYCLE OF A WASHING MACHINE APPLIANCE

(71) Applicant: Haier US Appliance Solutions, Inc., Wilmington, DE (US)

(72) Inventors: Seonghoon Ryu, Suwan-si (KR); Joohyun Park, Seongnam-si (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 123 days.

(21) Appl. No.: 18/357,057

(22) Filed: Jul. 21, 2023

(65) Prior Publication Data

US 2025/0027247 A1 Jan. 23, 2025

(51) Int. Cl.

| | |
|---|---|
| ***D06F 33/36*** | (2020.01) |
| ***D06F 34/22*** | (2020.01) |
| ***D06F 103/22*** | (2020.01) |
| ***D06F 105/58*** | (2020.01) |
| ***D06F 105/62*** | (2020.01) |

(52) U.S. Cl.

CPC ..... *D06F 33/36* (2020.02); *D06F 34/22* (2020.02); *D06F 2103/22* (2020.02); *D06F 2105/58* (2020.02); *D06F 2105/62* (2020.02)

(58) Field of Classification Search

CPC ..... D06F 2103/22

See application file for complete search history.

(56) References Cited

U.S. PATENT DOCUMENTS

| | | | | |
|---|---|---|---|---|
| 5,230,227 | A * | 7/1993 | Kondoh | D06F 34/22 706/900 |
| 10,508,375 | B2 | 12/2019 | Zattin et al. | |
| 11,149,376 | B2 | 10/2021 | Cha et al. | |
| 2019/0301073 | A1 | 10/2019 | Kessler et al. | |
| 2020/0319092 | A1* | 10/2020 | Schenkl | G05B 19/042 |
| 2021/0062397 | A1* | 3/2021 | Cha | D06F 39/02 |

FOREIGN PATENT DOCUMENTS

| | | | |
|---|---|---|---|
| CN | 104233700 | A | 5/2018 |
| DE | 102019203886 | A1 * | 9/2020 |
| JP | H04272796 | A | 9/1992 |

OTHER PUBLICATIONS

DE102019203886A1 Machine Translation (Year: 2020).*

* cited by examiner

*Primary Examiner* — Spencer E. Bell

(74) *Attorney, Agent, or Firm* — Dority & Manning, P.A.

(57) ABSTRACT

A method for operating a washing machine appliance may include a step of activating a wash cycle of the washing machine appliance. The method may also include a step of flowing a fill of liquid water to a tub of the washing machine appliance. The method may further include a step of flowing a wash substance to the tub of the washing machine appliance. The method may also include a step of monitoring conductivity measurements and turbidity measurements of the tub. The method may further include a step of determining a classification of the wash substance flowed to the tub of the washing machine appliance. The method may also include a step of comparing the determined classification of the wash substance to a selected classification of the wash substance.

20 Claims, 6 Drawing Sheets

400

| | AIR | LAUNDRY DETERGENT | FABRIC SOFTENER | BLEACH |
|---|---|---|---|---|
| REFERENCE CONDUCTIVITY VALUE | 0 μS/cm | 2797 μS/cm | 1800 μS/cm | 8000 μS/cm |
| REFERENCE TURBIDITY VALUE | 894 NTU | 695 NTU | 495 NTU | 745 NTU |

FIG. 4

DETECTING A WASH SUBSTANCE DURING A WASH CYCLE OF A WASHING MACHINE APPLIANCE

FIELD

The present subject matter relates generally to washing machine appliance, and more particularly to systems and methods for detecting a wash substance during a wash cycle of a washing machine appliance.

BACKGROUND

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Washing machine appliances can operate in numerous cycles. Wash substances may be used during the operation of these numerous wash cycles to help remove dirt, stains, oils, and other residues from fabrics of articles that may be present within the wash tub during the wash cycle. Many washing machine appliances allow a user to select a desired classification of wash substance to be used during the wash cycle. This preselection of the wash substance may allow the washing machine appliance to perform more effectively during the wash cycle.

However, in some cases, the actual wash substance that may be dispensed into the wash tub during a wash cycle may be different from the selected wash substance. In such cases, completing the wash cycle with the wrong wash substance may result in reduced performance of the washing machine appliance.

Accordingly, systems and methods that may be used to operate a washing machine appliance would be beneficial. Particularly, an algorithm that may be used to detect the classification of a wash substance that may be dispensed into a wash tub of the washing machine appliance and compare the detected wash substance to the selected classification of wash substance would be useful.

BRIEF DESCRIPTION

Aspects and advantages of the invention will be set forth in part in the following description, or may be apparent from the description, or may be learned through practice of the invention.

In one exemplary embodiment, a method for operating a washing machine appliance is provided. The method may include a step of activating a wash cycle of the washing machine appliance. The method may also include a step of flowing a fill of liquid water to a tub of the washing machine appliance. The method may further include a step of flowing a wash substance to the tub of the washing machine appliance. The method may also include a step of monitoring, with a sensor assembly, conductivity measurements and turbidity measurements of the tub, wherein the conductivity measurements and the turbidity measurements are monitored for a predetermined amount of time. The method may further include a step of determining, based on the monitored conductivity measurements and the monitored turbidity measurement, a classification of the wash substance flowed to the tub of the washing machine appliance. The method may also include a step of comparing the determined classification of the wash substance to a selected classification of the wash substance.

In another exemplary embodiment, a washing machine appliance is provided. The washing machine appliance may include a tub. The washing machine appliance may also include a sensor assembly disposed at the tub. The sensor assembly may be configured to continuously record a conductivity measurement and a turbidity measurement of the tub. The washing machine appliance may further include a controller operable for activating a wash cycle of the washing machine appliance; flowing a fill of liquid water to a tub of the washing machine appliance; flowing a wash substance to the tub of the washing machine appliance; monitoring, with a sensor assembly, conductivity measurements and turbidity measurements of the tub, wherein the conductivity measurements and the turbidity measurements are monitored for a predetermined amount of time; determining, based on the monitored conductivity measurements and the monitored turbidity measurement, a classification of the wash substance flowed to the tub of the washing machine appliance; and comparing the determined classification of the wash substance to a selected classification of the wash substance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 4 provides a table of values that may be stored on a controller of the exemplary washing machine appliance of FIG. 1.

Figure 1:
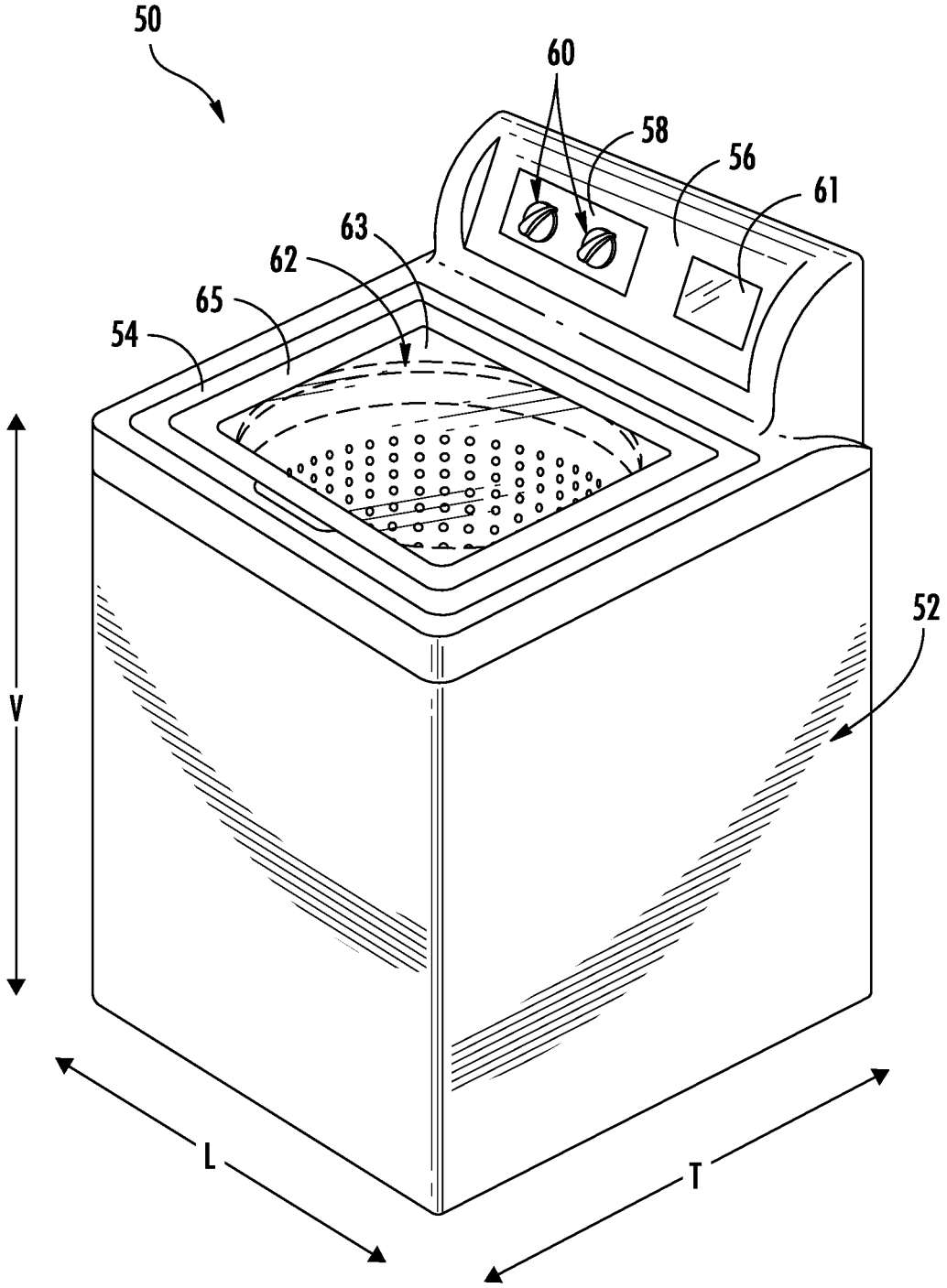
FIG. 1 provides a perspective view of a washing machine appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
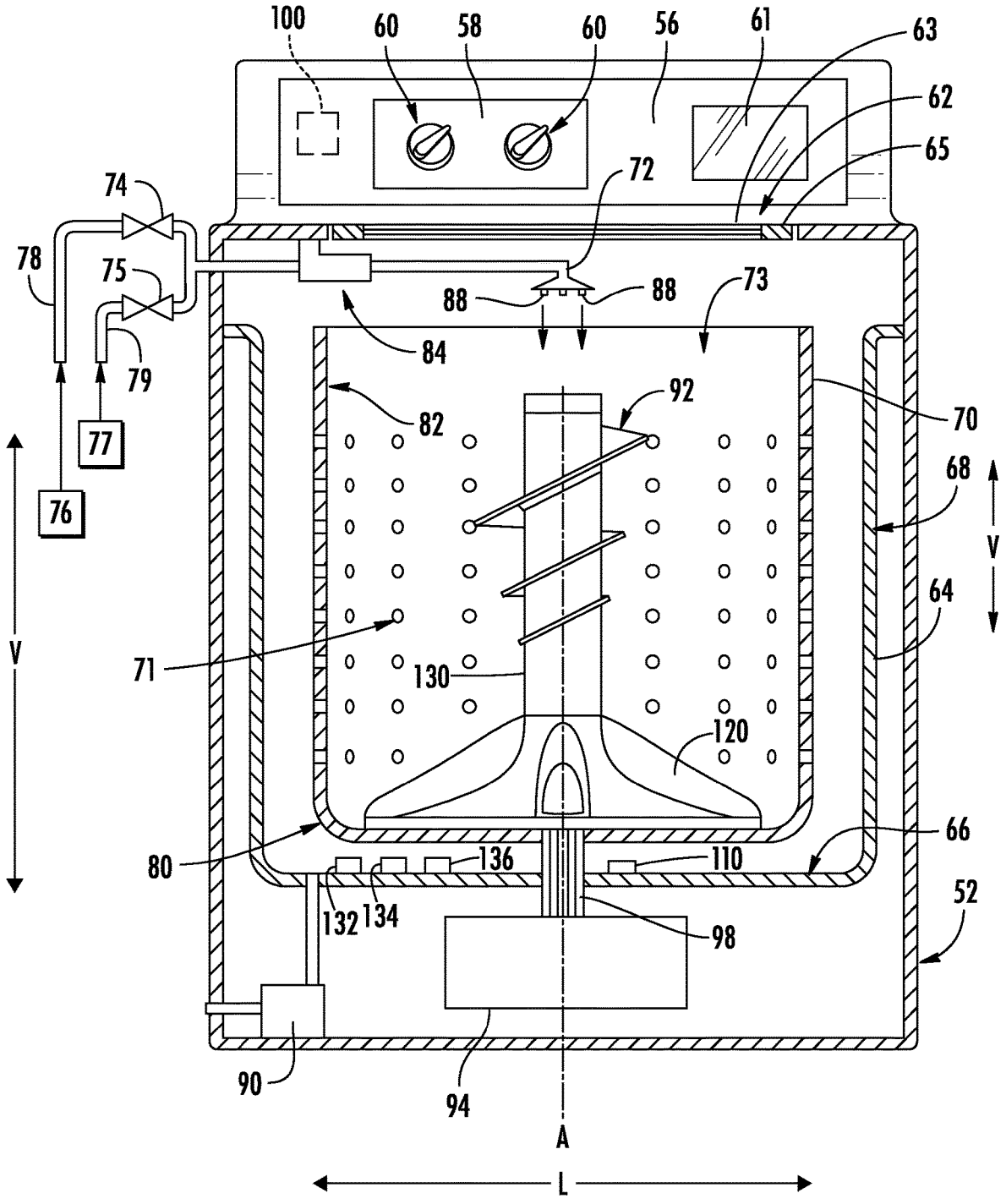
FIG. 2 provides a sectional elevation view of the exemplary washing machine appliance of FIG. 1.

Turning now to the figures, FIGS. 1 and 2 provide separate views of a washing machine appliance 50 according to example embodiments of the present disclosure. The washing machine appliance 50 may generally define a vertical direction V, a lateral direction L, and a transverse direction T. The vertical direction V, lateral direction L, and transverse direction T are each mutually perpendicular and form an orthogonal direction system.

One of ordinary skill in the art would understand that while described in the context of specific exemplary embodiment of the washing machine appliance 50, the present subject matter disclosed herein may be applicable to any suitable style, type, or configuration of washing machine appliance. For example, the present subject matter may also be applicable to front load washing machine appliances that may be commonly known in the art. Accordingly, the washing machine appliance 50 illustrated in FIGS. 1 and 2 may be provided by way of example only.

In some embodiments, the washing machine appliance 50 may include a cabinet 52 and a cover 54. In addition, a backsplash 56 may extend from cover 54, and a control panel 58 including one or more user input devices 60, such as one or more of a variety of digital, analog, electrical, mechanical, or electro-mechanical input devices including rotary dials, control knobs, push buttons, toggle switches, selector switches, and touch pads. As illustrated in FIGS. 1 and 2, the user input devices 60 may be a plurality of input selectors that may be coupled to the backsplash 56. In some embodiments, the control panel 58 and user input devices 60 may collectively form a user interface input for operator selection of machine cycles and features, and in one example embodiment, a display 61, such as a digital or analog display device generally configured to provide visual feedback regarding the operation of washing machine appliance 50. For example, display 61 may be provided on control panel 58 and may include one or more status lights, screens, or visible indicators. According to exemplary embodiments, user input devices 60 and display 61 may be integrated into a single device, e.g., including one or more of a touchscreen interface, a capacitive touch panel, a liquid crystal display (LCD), a plasma display panel (PDP), a cathode ray tube (CRT) display, or other informational or interactive displays may indicate selected features, a countdown timer, or other items of interest to machine users.

It should be appreciated, however, that in additional, or alternative, exemplary embodiments, the control panel 58, user input device 60, and display 61, may have any other suitable configuration. For example, in other example embodiments, one or more of the user input devices 60 may be configured as manual "push-button" input selectors, or alternatively may be configured as a touchscreen (e.g., on display 61).

A lid 62 may be mounted to cover 54 and rotatable between an open position (not shown) facilitating access to a tub 64, which may also be referred to as a wash tub 64, located within cabinet 52 and a closed position (FIG. 1) forming an enclosure over tub 64. As illustrated in FIG. 1, the lid 62 may include a transparent panel 63. In some embodiments, the transparent panel 63 may be formed of, for example, glass, plastic, or any other suitable material. The transparency of the panel 63 allows users to see through the panel 63, and into the tub 64 when the lid 62 is in the closed position. In some exemplary embodiments, the panel 63 itself can generally form the lid 62. In other example embodiments, for instance, FIG. 1, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the example embodiment illustrated be a vertical axis. Thus, the exemplary washing machine appliance 50 may generally referred to as a vertical axis washing machine appliance or a top load washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g., water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or may be holes defined in the nozzles 72 or any other suitable openings through which water may be sprayed. Nozzle 72 may additionally include other openings, holes, etc. (not shown) through which water may be flowed (i.e., sprayed or poured) into the tub 64.

Various valves may regulate the flow of fluid through nozzle 72. For example, a flow regulator may be provided to control a flow of hot or cold water into the wash chamber of washing machine appliance 50. For the example embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

A dispenser 84 may additionally be provided for directing a wash substance, for example, a wash additive or a cleaning agent, into the tub 64. For example, dispenser 84 may be in fluid communication with nozzle 72 such that water flowing through nozzle 72 flows through dispenser 84, mixing with wash substance at a desired time during operation to form a liquid or wash fluid, before being flowed into tub 64. For the example embodiment depicted, nozzle 72 is a separate downstream component from dispenser 84. In other example embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other example embodiments, the washing machine appliance 50 may not include a dispenser, in which case a user may add one or more wash substances directly to wash chamber 73. A pump assembly 90 (shown schematically in FIG. 2) may be located beneath tub 64 and basket 70 for gravity assisted flow to drain tub 64.

An agitation element 92 may be oriented to rotate about the rotation axis A (e.g., parallel to the vertical direction V). Generally, agitation element 92 includes an impeller base 120 and extended post 130. The agitation element 92 depicted may be positioned within the basket 70 to impart motion to the articles and liquid in the chamber 73 of the basket 70. More particularly, the agitation element 92 depicted may be provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70.

In optional example embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) that may be selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64.

In some embodiments, the various sensors may also include a turbidity sensor 132, a conductivity sensor 134, and a temperature sensor 136. Each of the turbidity sensor 132, conductivity sensor 134, and temperature sensor 136 may be configured for signal communication with controller 100 described in more detail below. For example, each of the turbidity sensor 132, conductivity sensor 134, and temperature sensor 136 may send measurement data or signals to controller 100. In some example embodiments, the turbidity sensor 132, the conductivity sensor 134, and the temperature sensor 136 may be combined in any combination to reduce the total number of sensors in washing machine appliance 50. For instance, the turbidity sensor 132, the conductivity sensor 134, and the temperature sensor 136, may be combined into a single component, wherein the combination of the sensors may be referred to as a sensor assembly. Further, turbidity sensor 132, conductivity sensor 134, and temperature sensor 136 may be positioned in tub 64, e.g., on a bottom wall 66 of tub 64.

During operation of the washing machine appliance 50, e.g., during a wash cycle of the washing machine appliance 50, a laundry items may be loaded into basket 70, and washing operation is initiated through operator manipulation of user input devices 60. Tub 64 may be filled with water, detergent, and/or other wash substances, for example, via dispenser 84. Hot water valve 74 and cold water valve 75 can be controlled by the controller 100 of the washing machine appliance 50 to provide for filling basket 70 to the appropriate level for the amount of articles being washed and/or rinsed. By way of example for a wash cycle, once basket 70 is properly filled with fluid, the contents of basket 70 can be agitated (e.g., with agitation element 92) for washing of laundry items in basket 70.

After the agitation phase of the wash cycle is completed, wash tub 124 can be drained. Laundry articles can then be rinsed by again adding fluid to tub 64, depending on the particulars of the cleaning cycle selected by a user. Agitation element 92 may again provide agitation within basket 70. One or more spin cycles may also be used. In particular, a spin cycle may be applied after the wash cycle and/or after the rinse cycle in order to wring wash fluid from the articles being washed. During a spin cycle, basket 70 is rotated at relatively high speeds. After articles disposed in wash basket 70 are cleaned and/or washed, the user can remove the articles from basket 70, e.g., by opening the lid 62 and reaching into basket 70.

The washing machine washing machine appliance 50 may further include or be in operative communication with a processing device or a controller 100 that may be generally configured to facilitate appliance operation. In this regard, control panel 58, user input devices 60, and display 61 may be in communication with controller 100 such that controller 100 may receive control inputs from user input devices 60, may display information using display 61, and may otherwise regulate operation of washing machine appliance 50. For example, signals generated by controller 100 may operate washing machine appliance 50, including any or all system components, subsystems, or interconnected devices, in response to the position of user input devices 60 and other control commands. Control panel 58 and other components of washing machine appliance 50 may be in communication with controller 100 via, for example, one or more signal lines or shared communication busses. In this manner, Input/Output ("I/O") signals may be routed between controller 100 and various operational components of washing machine appliance 50.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 100 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 100 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 100 may be operable to execute programming instructions or micro-control code associated with an operating cycle of washing machine appliance 50. In this regard, the instructions may be software or any set of instructions that when executed by the processing device, cause the processing device to perform operations, such as running one or more software applications, displaying a user interface, receiving user input, processing user input, etc. Moreover, it should be noted that controller 100 as disclosed herein is capable of and may be operable to perform any methods, method steps, or portions of methods as disclosed herein. For example, in some embodiments, methods disclosed herein may be embodied in programming instructions stored in the memory and executed by controller 100.

The memory devices may also store data that can be retrieved, manipulated, created, or stored by the one or more processors or portions of controller 100. The data can include, for instance, data to facilitate performance of methods described herein. The data can be stored locally (e.g., on controller 100) in one or more databases and/or may be split up so that the data is stored in multiple locations. In addition, or alternatively, the one or more database(s) can be connected to controller 100 through any suitable network(s), such as through a high bandwidth local area network (LAN) or wide area network (WAN). In this regard, for example, controller 100 may further include a communication module or interface that may be used to communicate with one or more other component(s) of washing machine appliance 50, controller 100, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Figure 3:
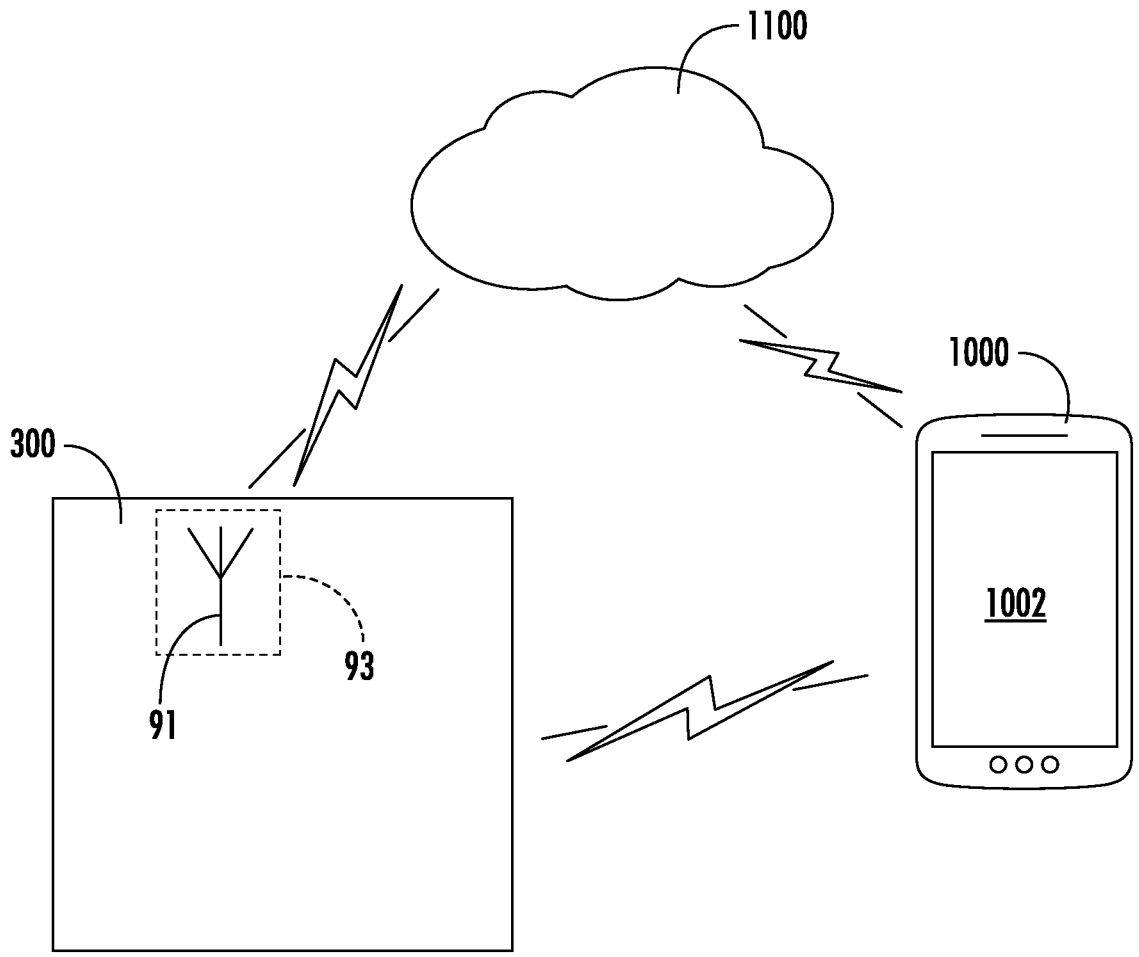
FIG. 3 provides a diagrammatic illustration of a washing machine appliance in communication with a remote computing device and with a remote user interface device according to one or more exemplary embodiments of the present subject matter.

Turning now to FIG. 3, a general schematic is provided of a washing machine appliance 300, such as but not limited to washing machine appliance 50 described above, which communicates wirelessly with a remote user interface device 1000 and a network 1100. For example, as illustrated in FIG. 3, the washing machine appliance 300 may include an antenna 91 by which the washing machine appliance 300 communicates with, e.g., sends and receives signals to and from, the remote user interface device 1000 and/or network 1100. The antenna 91 may be part of, e.g., onboard, a communications module 93. The communications module 93 may be a wireless communications module operable to connect wirelessly, e.g., over the air, to one or more other devices via any suitable wireless communication protocol. For example, the communications module 93 may be a WI-FI® module, a BLUETOOTH® module, or a combination module providing both WI-FI® and BLUETOOTH® connectivity. The remote user interface device 1000 may be a laptop computer, smartphone, tablet, personal computer, wearable device, smart speaker, smart home system, and/or various other suitable devices. The communications module 93 may be onboard the controller 100 or may be a separate module.

The washing machine appliance 300 may be in communication with the remote user interface device 1000 through various possible communication connections and interfaces. The washing machine appliance 300 and the remote user interface device 1000 may be matched in wireless communication, e.g., connected to the same wireless network. The washing machine appliance 300 may communicate with the remote user interface device 1000 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the washing machine appliance 300 and the remote user interface device 1000. For example, BLUETOOTH® Low Energy may advantageously minimize the power consumed by the exemplary methods and devices described herein due to the low power networking protocol of BLUETOOTH® Low Energy.

The remote user interface device 1000 is "remote" at least in that it is spaced apart from and not structurally connected to the washing machine appliance 300, e.g., the remote user interface device 1000 is a separate, stand-alone device from the washing machine appliance 300 which communicates with the washing machine appliance 300 wirelessly. Any suitable device separate from the washing machine appliance 300 that is configured to provide and/or receive communications, information, data, or commands from a user may serve as the remote user interface device 1000, such as a smartphone (e.g., as illustrated in FIG. 3), smart watch, personal computer, smart home system, or other similar device. For example, the remote user interface device 1000 may be a smartphone operable to store and run applications, also known as "apps," and some or all of the method steps disclosed herein may be performed by a smartphone app.

The remote user interface device 1000 may include a memory for storing and retrieving programming instructions. Thus, the remote user interface device 1000 may provide a remote user interface which may be an additional user interface to the control panel 58. For example, the remote user interface device 1000 may be a smartphone operable to store and run applications, also known as "apps," and the additional user interface may be provided as a smartphone app.

As mentioned above, the washing machine appliance 300 may also be configured to communicate wirelessly with a network 1100. The network 1100 may be, e.g., a cloud-based data storage system including one or more remote computing devices such as remote databases and/or remote servers, which may be collectively referred to as "the cloud." The network 1100 may include, e.g., one or more remote computing devices, such as a remote database, remote server, etc., in a distributed computing environment. Such distributed computing environments may include, for example, cloud computing, fog computing, and/or edge computing. For example, the washing machine appliance 300 may communicate with the network 1100 over the Internet, which the washing machine appliance 300 may access via WI-FI®, such as from a WI-FI® access point in a user's home, or in a laundromat or dormitory, etc.

In some embodiments, prior to operation of the washing machine appliance 50, a user may select operation condition and settings for a wash cycle of the washing machine appliance. For instance, a user may select the type of wash cycle and the type of wash substance that may use within the wash cycle. In some embodiments, these selections may be made via a user interacting with a user interface of the washing machine appliance 50. For example, in some embodiments, the user may select the operation conditions and settings via manipulation of the user input devices 60 on the control panel 58. As another example, in some embodiments, a user may select the operation conditions and settings via an app on a remote user interface device that may be connected to the washing machine appliance 50 via a network, for example, an app on remote user interface device 1000 that may be connected to the washing machine appliance 300 via network 1100.

In some embodiments, prior to operation of the washing machine appliance 50, the wash substance for the wash cycle may be selected. As used herein a "wash substance" may generally refer to a substance that may be added to the washing machine appliance 50, for example, to a tub 64 of the washing machine appliance 50 via the dispenser 84 during a wash cycle of the washing machine appliance 50 to enhance the cleaning performance or act as a cleaning agent. In this regard, the wash substance that may be selected prior to the operation may be a wash additive, for example, an additive or substance that may be provided to enhance the cleaning performance such as fabric softener, scent boost, color enhancer, etc., or may be a cleaning agent, for example, a substance that is configured to remove, dirt, stains, grease, or any other unwanted materials from the surface of a laundry article, such as laundry detergent, bleach, etc.

In some embodiments, prior to operation of the washing machine appliance 50, a user may be able to select from a predetermined list of wash substances that may be used during the wash cycle. For example, the predetermined list may include laundry detergent, fabric softener, and bleach. For each wash substance in the predetermined list, reference conductivity values and references turbidity values may be known. During the wash cycle, these values may be continuously monitored to ensure that the wash substance that may be dispensed into the tub 64 during the wash cycle matches, for example, is the same as, the wash substance selected by the user.

For example, referring now to FIG. 4, table 400 that may be stored in the memory of controller 100 according to one or more embodiments of the present subject matter is provided. The table 400 may contain reference conductivity values and reference turbidity values of various wash substances that may be dispensed or flowed into the tub 64 of the washing machine appliance 50 during a wash cycle. With table 400 of FIG. 4 stored in the memory of controller 100, controller 100 may be configured to determine a presence of and a type of wash substance that may be in tub 64 via the values of the conductivity measurements and the turbidity measurements.

As illustrated in FIG. 4, in some embodiments, reference conductivity values and reference turbidity values for air, laundry detergent, fabric softener, and bleach are provided. Specifically, as illustrated in FIG. 4, the reference conductivity value of air may be approximately zero micro-Siemens per centimeter (0 μS/cm) and the reference turbidity value of air may be eight hundred and ninety four Nephelometric Turbidity units (894 NTU). The reference conductivity value of a laundry detergent, for example, a liquid laundry detergent, may be approximately two thousand seven hundred and ninety seven micro-Siemens per centimeter (2797 μS/cm) and the reference turbidity value of laundry detergent may be six hundred and ninety five Nephelometric Turbidity units (695 NTU). The reference conductivity value of a fabric softener may be approximately one thousand eight hundred micro-Siemens per centimeter (1800 μS/cm) and the reference turbidity value of fabric softener may be four hundred and ninety five Nephelometric Turbidity units (495 NTU). The reference conductivity value of a disinfectant, for example, bleach, may be approximately eight thousand micro-Siemens per centimeter (8000 μS/cm) and the reference turbidity value of the disinfectant, for example, bleach, may be seven hundred and forty five Nephelometric Turbidity units (745 NTU).

One of ordinary skill in the art would understand that the reference conductivity values provided in the table 400 are provided by way of example only. In some embodiments, the reference conductivity values, and the reference turbidity values of a wash substance may be any suitable value that may represent the approximate conductivity measurement and turbidity measurement of the respective wash substance.

In addition, one of ordinary skill in the art would understand that the various wash substances provided in table 400, for example, air, laundry detergent, fabric softener, and bleach, are provided by way of example only. In some embodiments, the table 400 may include any suitable wash substance, and the corresponding reference conductivity and turbidity values, that may be used during a wash cycle of a washing machine appliance in various combinations with some or all (or none) of the example wash substances in table 400. For example, in some embodiments, the table 400 may include stain removers, vinegar, commercially available wash substances, and the corresponding reference conductivity values and reference turbidity values for these wash substances.

In some embodiments, during operation of a wash cycle the washing machine appliance 50 the wash substance that may be dispensed into the tub 64 may differ from the wash substance that may be selected, for example, by a user, prior to the operation of the wash cycle. In such instances, the controller 100 may be configured to determine or detect the inappropriate substance that may have been dispensed into the tub 64. For instance, the controller 100 may be configured to execute an algorithm 500 that operates the washing machine appliance 50 in general. More specifically, the controller 100 may be configured to execute the algorithm 500 to determine if a classification of the wash substance dispensed is the same as, or different than, the classification of the wash substance selected.

Figure 5:
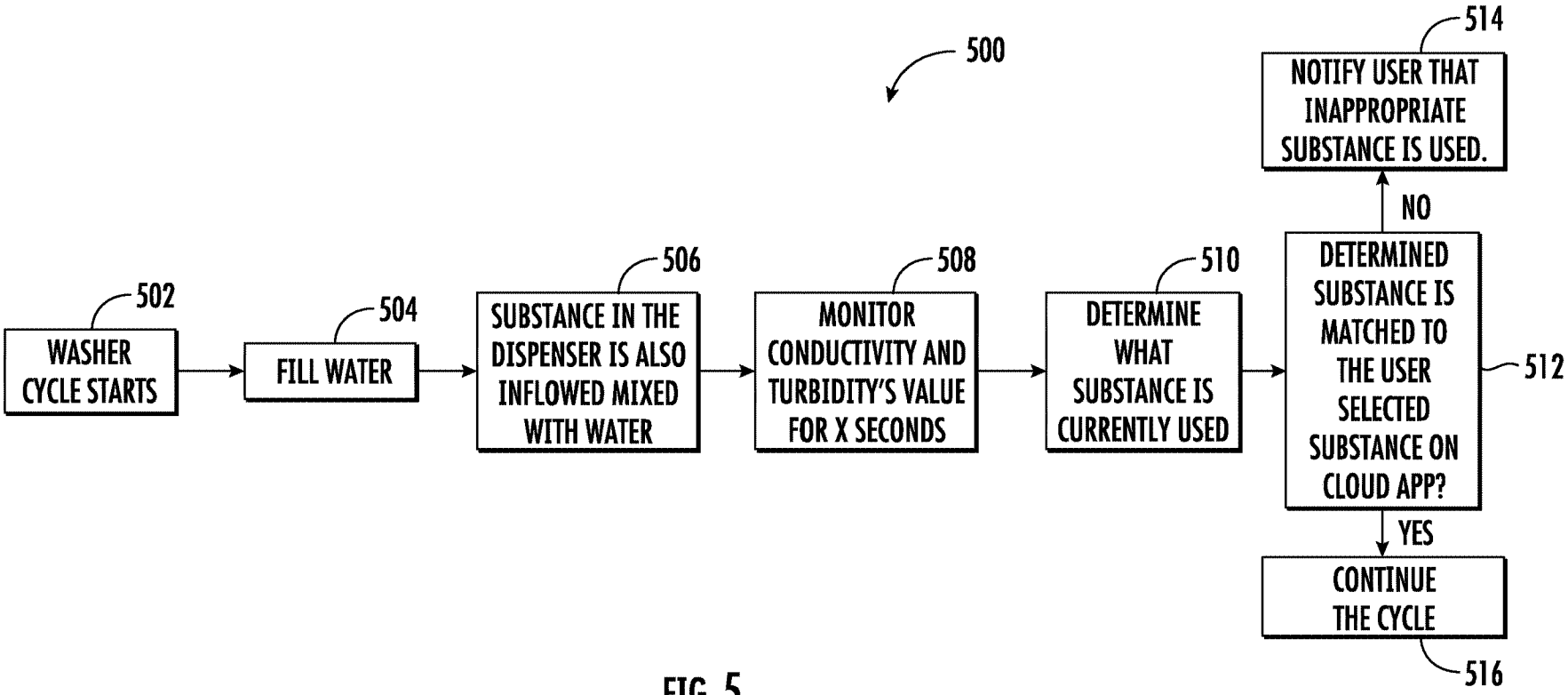
FIG. 5 provides a flow diagram of an algorithm that may be used to operate a washing machine appliance according to one or more exemplary embodiments of the present subject matter.

Referring now to FIG. 5, a flow diagram of the algorithm 500 that may be used to operate a washing machine appliance, such as the washing machine appliance 50, according to one or more exemplary embodiments of the present subject matter is provided. The algorithm 500 described herein, and illustrated in FIG. 5, may be implemented on any suitable washing machine appliance, for example, to operate the washing machine appliance. For instance, a controller of the washing machine appliance, such as the controller 100 of the microwave oven appliance 50, may be operable for implementing the functions of the algorithm 500 such as to operate the washing machine appliance.

In some embodiments, the algorithm 500 may include a process function 502. The process function 502 may include activating a wash cycle of the washing machine appliance. For instance, at process function 502 the wash cycle may be activated in response to receiving inputs indicative of the operation conditions and settings of the wash cycle. In some embodiments, the operation conditions and settings of the wash cycle may include conditions, such as water temperature, load size, classification of wash substance, cycle duration, etc. In some embodiments, the classification of wash substance may correspond to the type of wash substance that may be used in the wash cycle. For instance, as mentioned above, prior to the operation of a washing machine appliance a user may select a classification of wash substance that may be used during the wash cycle.

In some embodiments, the algorithm 500 may also include a process function 504. The process function 504 may include flowing a fill of liquid water to a tub of the washing machine appliance. For instance, at process function 504, a fill of liquid water may flow into the tub of the washing machine appliance, through a nozzle, such as nozzle 72 of the washing machine appliance 50. As described above, various valves may regulate the flow of the fill of liquid water through the nozzle.

In some embodiments, the algorithm 500 may further include a process function 506. The process function 506 may include flowing a wash substance to the tub of the washing machine appliance. For instance, at process function 506, a wash substance may be directed into the tub of the washing machine appliance via a dispenser, such as the dispenser 84 of the washing machine appliance 50. As described above, in some embodiments, the dispenser may be in fluid communication with the nozzle such that water flowing through the nozzle may flow through the dispenser. In this regard, the wash substance may be mixed with liquid water to form a wash fluid, for example, a mixture of liquid water and a wash substance that may be suitable for effectively laundering articles in the tub of the washing machine appliance.

In some embodiments, the algorithm 500 may further include a process function 508. The process function 508 may include monitoring conductivity measurements and turbidity measurements of the tub, and more particularly of the wash fluid that may be within the tub. In some embodiments, at the process function 508, the conductivity measurements and the turbidity measurements may be monitored via a sensor assembly, that may include a conductivity sensor, for example, the conductivity sensor 134 described in more detail above, and a turbidity sensor, for example, the turbidity sensor 132 described in more detail above. In some embodiments the term "monitor" (when used as a verb and including cognates thereof such as "monitoring") may herein refer to the sensor assembly continuously sensing, for example, observing and collecting data, of the conductivity measurements and the turbidity measurements. In addition, in some embodiments, the sensor assembly may be configured to monitor the conductivity measurements and the turbidity measurements for a predetermined amount of time. For instance, in response to the wash substance flowing into the tub at 506, the process function 508 may monitor the conductivity measurements and the turbidity measurements of the tub, and more particularly the wash fluid within the tub for a predetermined amount of time.

In some embodiments, the algorithm 500 may also include a process function 510. The process function 510 may include determining a classification of the wash substance flowing to the tub of the washing machine appliance. In some embodiments, the process function 510 may be based on the monitored conductivity measurements and the monitored turbidity measurement, for instance, as monitored at process function 508. In some embodiments, the monitored conductivity measurements and the monitored turbidity measurements may each include a value pattern. The value pattern of each of the monitored measurements may include the regularity, trend, or structure of the conductivity measurements and the turbidity measurements that may be monitored, for instance, at process function 508. In addition, the value pattern of the monitored conductivity measurements and the value patterns of the monitored turbidity measurement may be compared to reference conductivity values and reference turbidity values, respectively, to determine a classification, for example, a type, of wash substance flowing to the tub of the washing machine appliance. For instance, the value patterns of the monitored conductivity measurements and the value patterns of the monitored turbidity measurement may be compared with the reference conductivity values and the reference turbidity values described and illustrated in FIG. 4 to determine the classification of the wash substance flowing to the tub. For example, at process function 510, it may be determined that the wash substance may be laundry detergent, fabric softener, or a disinfectant, such as bleach.

In some embodiments, the algorithm 500 may include a decision function 512. The decision function 512 may include comparing the determined classification of the wash substance to a selected classification of the wash substance. As described above, the classification of the wash substance flowing to the tub of the washing machine appliance may be determined at process function 510 and the classification of the wash substance may be selected prior to operation of the wash cycle, such as prior to the process function 502.

In some embodiments, the algorithm 500 may include a process function 514 that may be executed in response to a negative decision from the decision function 512. For instance, the process function 514 may be executed in response to it being decided at decision function 512 that the determined classification of the wash substance is different from the selected classification of the wash substance. The process function 514 may include pausing the wash cycle of the washing machine appliance. In addition, the process function 514 may include providing a user notification on a remote user interface device in response to the determined classification being different from the selected classification. The user notification may include a prompt that indicates the determined classification of the wash substance is different from the selected classification of the wash substance.

In some embodiments, the algorithm 500 may include a process function 516 that may be executed in response to a positive decision from the decision function 512. For instance, the process function 514 may be executed in response to it being decided at decision function 512 that the determined classification of the wash substance is the same as the selected classification of the wash substance. The process function 516 may include continuing the wash cycle such that the wash cycle may be fully executed, for example, completed.

Figure 6:
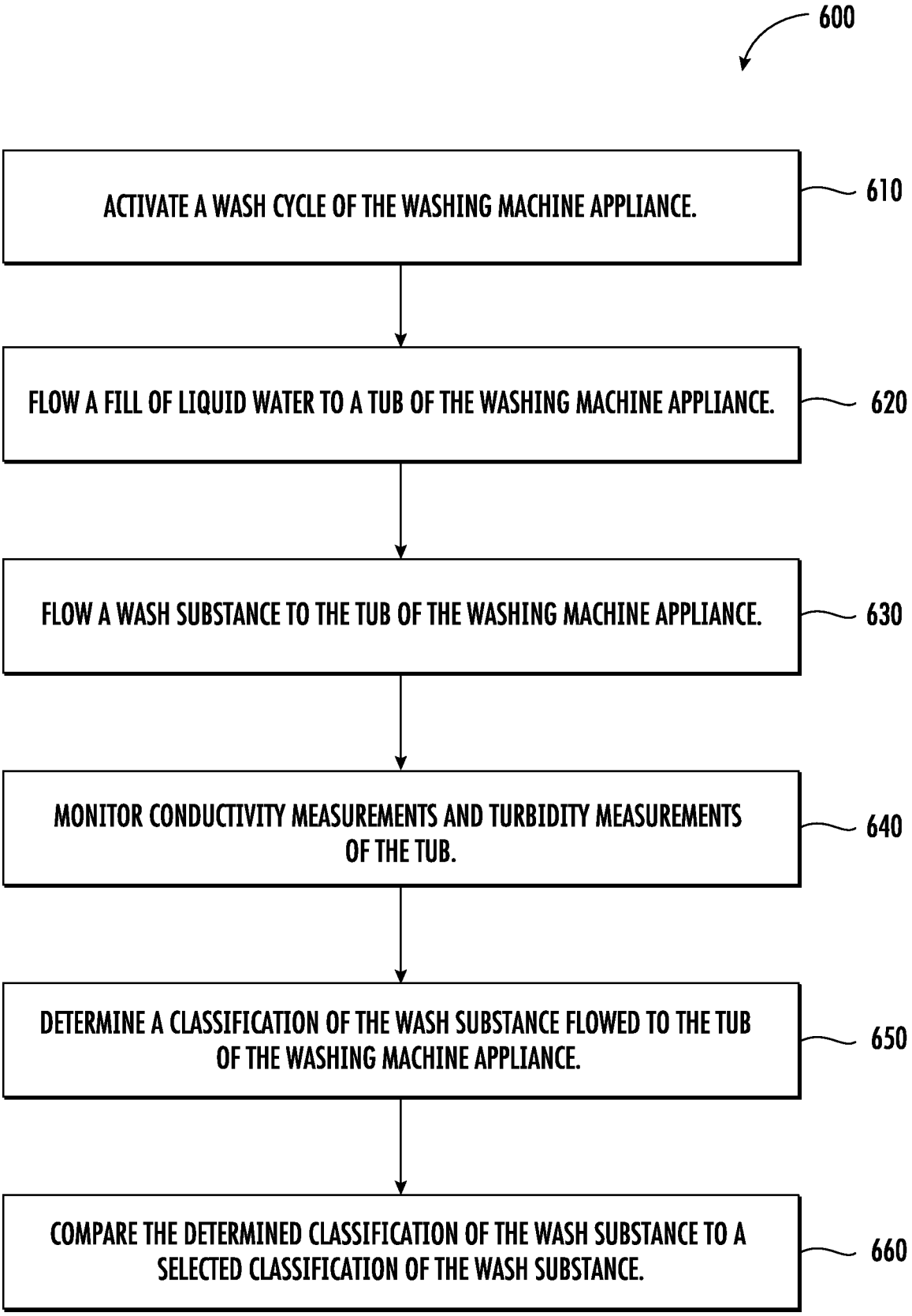
FIG. 6 provides a flow chart of an exemplary method of operating a washing machine appliance according to one or more exemplary embodiments of the present subject matter.

Referring now to FIG. 6, embodiments of the present subject matter may include one or more methods for operating a washing machine appliance, such as the exemplary washing machine appliance 50 described above, as well as other possible exemplary washing machine appliances. The exemplary methods according to the present subject matter may include a method 600, for example, as illustrated in FIG. 6. A controller of the washing machine appliance, such as the controller 100 of the exemplary washing machine 50, may be programmed to implement method 600, for example, the controller, such as controller 100, may be capable of and may be operable to perform any methods and associated method steps as disclosed herein.

In some embodiments, the method 600 may include a step of selecting, on a user interface device, a classification of a wash substance that is to be used during a wash cycle of the washing machine appliance. For example, in some embodiments, a user may select the classification of the wash substance that is to be used on a remote user interface device that may be connected to the washing machine appliance, for instance, via a network. In this regard, performance of a wash cycle of the washing machine appliance may be improved as operation settings of the wash cycle may be adjusted based on the classification of the wash substance selected. For instance, in some embodiments, operations settings, for example, the temperature of the fill of liquid water, the volume of the fill of liquid water, and the time of the wash cycle, may be adjusted based on the classification of the wash cycle.

In some embodiments, the method 600 may include a step 610 of activating a wash cycle of the washing machine appliance. As described above, activating the wash cycle of the washing machine appliance may include receiving inputs indicative of the operation conditions and settings of the wash cycle. As mentioned above, these operation conditions and settings of the wash cycle may be based, at least in part on, a classification of a wash substance that may be selected, for instance, by a user via a remote user interface device that may be connected to the washing machine appliance.

In addition, the method 600 may also include a step 620 of flowing a fill of liquid water to a tub of the washing machine appliance. As described above, flowing a fill of liquid water to the tub may include regulating a valve in fluid communication with a nozzle of the washing machine appliance such that a fill of liquid water may flow to the tub via the nozzle. In some embodiments, the volume and temperature of the fill of liquid water may be based, at least in part, on the classification of wash substance that may be selected, for instance, by a user via a remote user interface device that may be connected to the washing machine appliance.

The method 600 may further include a step 630 of flowing a wash substance to the tub of the washing machine appliance. As described above, flowing a wash substance to the tub may include directing a wash substance to the tub via a dispenser of the washing machine appliance that may be in fluid communication with the nozzle. In some embodiments, the wash substance may be a cleaning agent or a wash additive.

The method 600 may also include a step 640 of monitoring, with a sensor assembly, conductivity measurements and turbidity measurements of the tub, wherein the conductivity measurements and the turbidity measurements are monitored for a predetermined amount of time. In some embodiments, the sensor assembly may include a conductivity sensor, for example, the conductivity sensor 134, and a turbidity sensor, for example, the turbidity sensor 132. In some embodiments, the monitored conductivity measurements, and turbidity measurements may each include a value pattern. In addition, the classification of the wash substance may be determined based on the value pattern of the monitored conductivity measurements and the value pattern of the monitored turbidity measurements. As described above, the value pattern of each of the monitored measurements may include the regularity, trend, or structure of the conductivity measurements and the turbidity measurements that may be monitored.

The method 600 may further include a step 650 of determining, based on the monitored conductivity measurements and the monitored turbidity measurement, a classification of the wash substance flowed to the tub of the washing machine appliance. In some embodiments, the value patterns of the monitored conductivity measurements and the monitored turbidity measurements may each be compared to a reference conductivity value and a reference turbidity value, see, e.g., FIG. 4, respectively, to determine a determined classification of the wash substance. In this regard the determined classification of the wash substance may be the actual classification or type of wash substance that may be dispensed into the wash tub.

The method 600 may also include a step 660 of comparing the determined classification of the wash substance to a selected classification of the wash substance. In some embodiments, the step 660 may include comparing the determined classification of the wash substance that may be determined at step 650 and the selected classification of the wash substance that may have been selected by a user. In some embodiments the method 600 may include a step of determining, based on the compared determined classification of the wash substance to the selected classification of wash substance, that the determined classification of the wash substance is different from the selected classification of the wash substance. The method 600 may also include a step of pausing the wash cycle of the washing machine appliance in response to the determined classification being different from the selected classification. The method 600 may also include a step of providing a user notification on a remote user interface device in response to the determined classification being different from the selected classification, wherein the user notification comprises a prompt that indicates the determined classification of the wash substance is different from the selected classification of the wash substance.

In some embodiments, the method 600 may include a step of determining, based on the compared determined classification of the wash substance to the selected classification of the wash substance, that the determined classification of the wash substance is the same as the selected classification of the wash substance. The method 600 may include continuing the wash cycle of the washing machine appliance in response to it being determined that the determined classification of the wash substance is the same as the selected classification of the wash substance.

Embodiments of the present subject matter advantageously provide systems and methods for determining an inappropriate wash substance usage in a washing machine appliance by comparing a determined wash substance, for instance, a wash substance that may be in the dispenser of the washing machine appliance based on monitored turbidity measurements and monitored conductivity measurements obtained using turbidity and conductivity sensors. In various exemplary embodiments, when a wash cycle of a washing machine appliance starts, the substance in the dispenser may be mixed with a fill of liquid water. The turbidity and conductivity sensors of the washing machine appliance may monitor the turbidity measurements and conductivity measurements for a predetermined amount of time, such that value patterns may be formed for the turbidity measurements and the conductivity measurements. After the predetermined amount of time, the controller of the washing machine appliance may compare the conductivity and turbidity value patterns to reference conductivity and turbidity values to determine what substance may be being used currently. A controller of the washing machine appliance may then compare the determined classification of substance with the user selected classification of wash substance. If there is a mismatch, the controller of the washing machine appliance may advantageously pause the current wash cycle and may also send a notification to a user notifying an inappropriate wash substance was used in the current washing cycle. In this regard, a user may choose to either stop the current wash cycle or continue with the current washing cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the method comprising:

receiving, from a remote user interface device, a user input indicating an operation of a wash cycle at the washing machine appliance, wherein the user input includes a user-selected classification of a target wash substance to be utilized during the wash cycle, wherein the user-selected classification of the target wash substance comprises a target wash additive;

activating the wash cycle of the washing machine appliance in response to receiving the user input;

flowing a fill of liquid water to a tub of the washing machine appliance;

flowing a wash substance to the tub of the washing machine appliance;

monitoring, with a sensor assembly, conductivity measurements and turbidity measurements of a fluid in the tub in response to flowing the wash substance to the tub of the washing machine appliance, wherein the conductivity measurements and the turbidity measurements are monitored for a predetermined amount of time;

determining, based on the monitored conductivity measurements and the monitored turbidity measurement, a classification of the wash substance flowed to the tub of the washing machine appliance; and comparing the determined classification of the wash substance to the user-selected classification of the target wash substance.

2. The method of claim 1, further comprising determining, based on the compared determined classification of the wash substance to the user-selected classification of the target wash substance, that the determined classification of the wash substance is different from the user-selected classification of the target wash substance.

3. The method of claim 2, further comprising pausing the wash cycle of the washing machine appliance in response to the determined classification being different from the user-selected classification.

4. The method of claim 2, further comprising providing a user notification on the remote user interface device in response to the determined classification being different from the user-selected classification, wherein the user notification comprises a prompt that indicates the determined classification of the wash substance is different from the user-selected classification of the target wash substance.

5. The method of claim 1, further comprising determining, based on the compared determined classification of the wash substance to the user-selected classification of the target wash substance, that the determined classification of the wash substance is the same as the user-selected classification of the target wash substance.

6. The method of claim 5, wherein the wash cycle of the washing machine appliance is continued.

7. The method of claim 1, wherein the monitored conductivity measurements and turbidity measurements each comprise a value pattern.

8. The method of claim 7, wherein the classification of the wash substance is determined based on the value pattern of the monitored conductivity measurements and the value pattern of the monitored turbidity measurements.

9. The method of claim 1, wherein the sensor assembly comprises a conductivity sensor and a turbidity sensor and wherein the conductivity sensor and the turbidity sensor are combined into a single component to form the sensor assembly.

10. The method of claim 1, wherein the wash substance is a cleaning agent or a wash additive.

11. A washing machine appliance comprising:

a tub;

a sensor assembly positioned on a bottom wall of the tub, the sensor assembly configured to continuously record a conductivity measurement and a turbidity measurement of a fluid in the tub; and a controller, the controller operable for receiving, from a remote user interface device in operative communication with the controller, a user input indicating an operation of a wash cycle at the washing machine appliance, wherein the user input includes a user-selected classification of a target wash substance to be utilized during the wash cycle, wherein the user-selected classification of the target wash substance comprises a target wash additive;

activating the wash cycle of the washing machine appliance in response to receiving the user input;

flowing a fill of liquid water to the tub of the washing machine appliance;

flowing a wash substance to the tub of the washing machine appliance;

monitoring, with the sensor assembly, conductivity measurements and turbidity measurements of a fluid in the tub in response to flowing the wash substance to the tub of the washing machine appliance, wherein the conductivity measurements and the turbidity measurements are monitored for a predetermined amount of time;

determining, based on the monitored conductivity measurements and the monitored turbidity measurement, a classification of the wash substance flowed to the tub of the washing machine appliance; and comparing the determined classification of the wash substance to the user-selected classification of the target wash substance.

12. The washing machine appliance of claim 11, wherein the controller is further operable for determining, based on the compared determined classification of the wash substance to the user-selected classification of the target wash substance, that the determined classification of the wash substance is different from the user-selected classification of the target wash substance.

13. The washing machine appliance of claim 12, wherein the controller is further operable for pausing the wash cycle of the washing machine appliance in response to the determined classification being different from the user-selected classification.

14. The washing machine appliance of claim 12, wherein the controller is further operable for providing a user notification on the remote user interface device in response to the determined classification being different from the user-selected classification, wherein the user notification comprises a prompt that indicates the determined classification of the wash substance is different from the user-selected classification of the target wash substance.

15. The washing machine appliance of claim 11, wherein the controller is further operable for determining, based on the compared determined classification of the wash substance to the user-selected classification of the target wash substance, that the determined classification of the wash substance is the same as the user-selected classification of the target wash substance.

16. The washing machine appliance of claim 15, wherein the wash cycle of the washing machine appliance is continued.

17. The washing machine appliance of claim 11, wherein the monitored conductivity measurements and turbidity measurements each comprise a value pattern.

18. The washing machine appliance of claim 17, wherein the classification of the wash substance is determined based on the value pattern of the monitored conductivity measurements and the value pattern of the monitored turbidity measurements.

19. The washing machine appliance of claim 11, wherein the sensor assembly comprises a conductivity sensor and a turbidity sensor.

20. The washing machine appliance of claim 11, wherein the wash substance is a cleaning agent or a wash additive.

* * * * *